US005271589A

United States Patent [19]

Belous

[11] Patent Number: 5,271,589

[45] Date of Patent: Dec. 21, 1993

[54] DISPOSABLE BAG SUPPORT

[76] Inventor: Philip Belous, 13816 Bora Bora Way, #109A, Marina Del Rey, Calif. 90291

[21] Appl. No.: 973,177

[22] Filed: Nov. 9, 1992

[51] Int. Cl.[5] ..... B65B 67/00

[52] U.S. Cl. ..... 248/97; 248/99

[58] Field of Search ..... 248/97, 99, 152, 150

[56] References Cited

U.S. PATENT DOCUMENTS

| | | | |
|---|---|---|---|
| 672,657 | 4/1901 | Vautrot . | |
| 725,721 | 4/1903 | Kenney | 248/97 |
| 1,234,057 | 7/1917 | McIntyre . | |
| 1,414,575 | 5/1922 | McCart | 248/97 |
| 1,858,793 | 5/1932 | Reynolds | 248/97 |
| 3,734,340 | 5/1973 | Ippolito et al. . | |
| 3,983,914 | 10/1976 | Benson . | |
| 4,037,778 | 7/1977 | Boyle . | |
| 4,115,909 | 9/1978 | Corella . | |
| 4,273,167 | 6/1981 | Stillwell | 248/97 X |
| 4,530.533 | 7/1985 | Dieter . | |
| 4,628,007 | 12/1986 | Ledsham . | |
| 4,749,011 | 6/1988 | Rylander . | |
| 4,890,652 | 1/1990 | Hoerner . | |
| 4,940,200 | 7/1990 | Sawyer et al. | 248/99 X |
| 4,955,496 | 9/1990 | Nelson . | |
| 4,979,547 | 12/1990 | Hoerner . | |

*Primary Examiner*—Alvin C. Chin-Shue
*Assistant Examiner*—Sarah A. Lechok
*Attorney, Agent, or Firm*—Blakely, Sokoloff, Taylor & Zafman

[57] ABSTRACT

A device for supporting a plastic trash bag in an open and upright position while protecting the plastic bag from becoming ripped and punctured is disclosed. The device is made up of a tubular base and a funnel member. The tubular base, made of corrugated paper having waxed interior and exterior surfaces, has of a plurality of side panels some of which have cut slits to receive flaps from the funnel member for interconnection between the two components.

The funneling unit has an interlocking means coupled to its opposite ends to interconnect the ends to form the funnel shaped. The funneling unit further comprises a fastening means for affixing the funneling unit to the tubular base. The funneling unit also has a means for securing the plastic bag in an open and upright position.

When the tubular base is inserted into the plastic trash bag, the plastic bag is raised into an open and upright position and secured by the securing means. After being filled, the plastic bags are detached from the securing means and the tubular base is removed causing the plastic trash bag to fill and remain in an open and upright position.

14 Claims, 3 Drawing Sheets

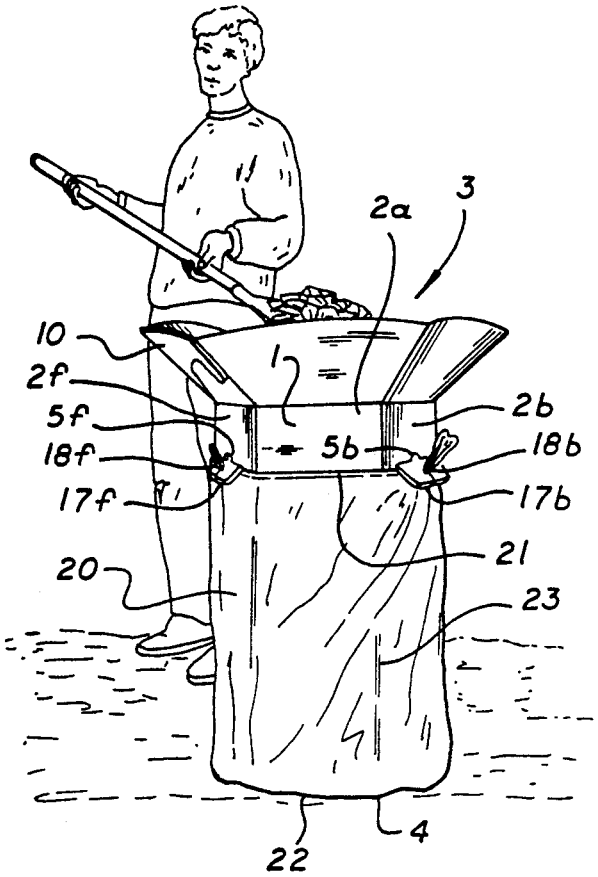
FIG. 1
FIG. 3
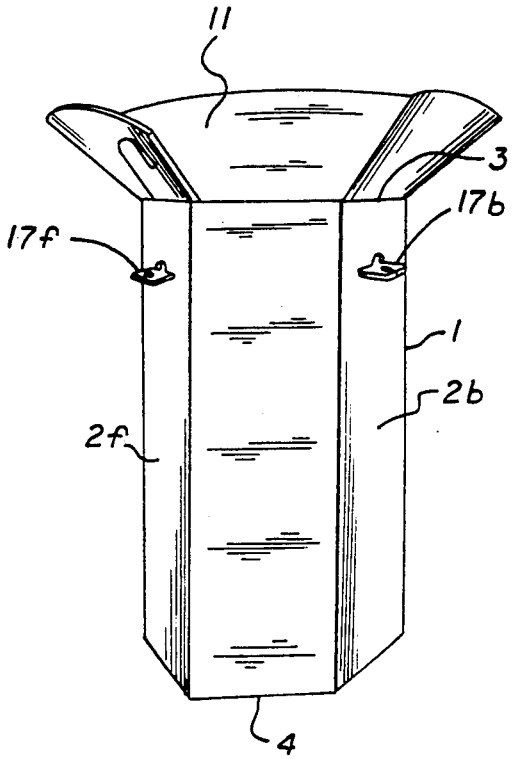
FIG. 2
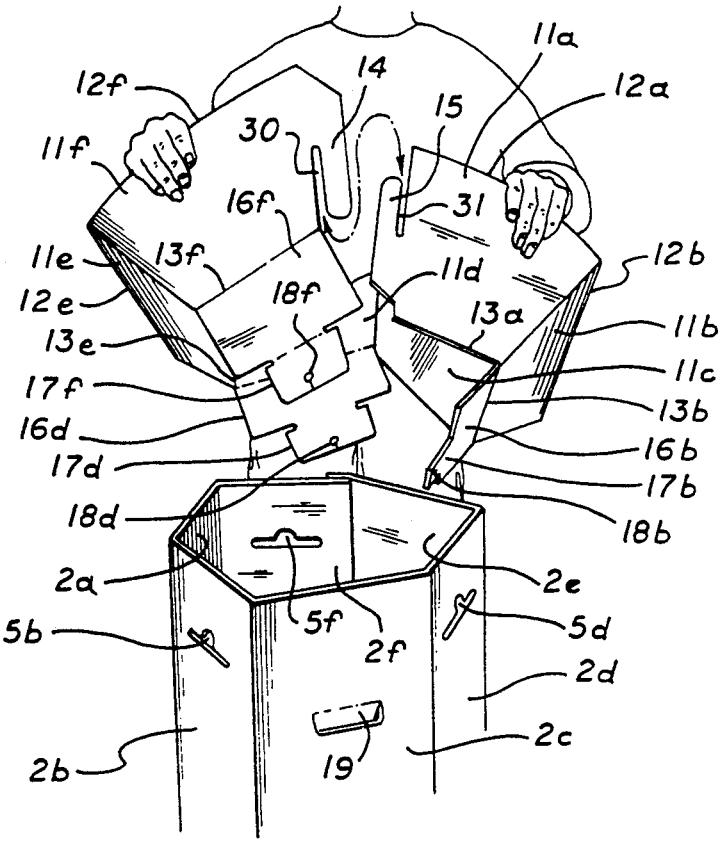

DISPOSABLE BAG SUPPORT

BACKGROUND OF THE INVENTION

1. Field of the Invention

The present invention relates to a device which supports a plastic trash bag in an open and upright position so that an individual can easily fill the trash bag without having to repeatedly re-open it or obtain the assistance of other persons.

2. Art Background

In recent years, consumers have more regularly purchased and used plastic trash bags based upon four advantages not found in trash cans or any other conventional disposal receptacles.

First, plastic trash bags are made of a light weight, non-supportive, flexible plastic material unlike disposal receptacles such as standard thirty gallon outdoor trash cans which are normally made of rigid plastic or metal. Due to their light construction, plastic trash bags are frequently being used by many homeowners because standard thirty gallon trash cans are heavy, bulky, difficult to carry for a prolonged distance and difficult to store in small areas. Moreover, residents of apartments and condominium complexes almost solely use trash bags since each resident must deposit one's trash in a central dumpster which could be hundreds of yards away and multiple floors below one's residence.

Secondly, plastic trash bags provide an inexpensive disposal or storage means. Trash bags usually come in a package of five to ten trash bags which sells for a few dollars. Professional gardening crews particularly rely on trash bags in lieu of outdoor trash cans to efficiently perform their duties. Each individual within the gardening crew is assigned a specific task such as cutting grass or raking leaves and is given a trash bag to dispose of the refuse. As a result, gardening crews can quickly complete large gardening jobs and pass on the savings to its employers through lower rates.

Thirdly, unlike most disposal receptacles which are heavy and inflexible, trash bags are flexible enough to fit within the trunk of one's car enabling persons to transport items within the trash bags while protecting the car's trunk lining from the contents therein. Such a feature is extremely valuable to our country's recycling movement.

Finally, trash bags are completely disposable, a desirable feature when disposing odorous materials. Conventional receptacles, however, accumulate odors and remains of disposed items thereby requiring constant cleaning to remove such odors and remains.

Although trash bags offer many advantages over other disposal containers, there are two major disadvantage associated with using plastic trash bags.

The first major disadvantage is that plastic trash bags are extremely difficult to fill, particularly when one begins to fill a new trash bag because the trash bags commonly collapse due to their flexible and non-supportive nature. As a result, an appreciable amount of time and energy is wasted because in order to prevent the trash bag from collapsing and spilling its contents, a consumer must either hold the trash bag open with one hand and collect the disposable items with the other hand or obtain the assistance of another individual to hold the trash bag open. However, if a person is working by oneself and needs to use both hands for the collection of the disposable items such as leaves or grass cuttings, it would be extremely advantageous to have a device which holds a plastic trash bag firmly in place thereby freeing both hands of the consumer.

The second disadvantage is that plastic trash bags are made of a thin plastic material primarily for economic reasons. Thus, the bags are extremely susceptible to tearing when foliage such as tree branches, thorny bush clippings and similar matter are placed within the trash bag. Punctures in the trash bag walls reduce the overall strength of the trash bag's side walls and tend to propagate downward allowing previously disposed items to escape the confines of the bag. Such a condition is not desirable especially when grass cuttings and other items having small surface area are contained within the bag.

Many different types of plastic trash bag holders have been previously developed over the years in an attempt to overcome the above-mentioned disadvantages. These previous trash bag holders can be divided into two groups: those holders which support a plastic trash bag from its outside and holders which support a plastic trash bag from its inside.

With respect to the former, in order to mitigate its first disadvantage, trash bags have been used essentially as liners for disposal receptacles. However, such use also eliminates some of the advantages associated with plastic trash bags. Furthermore, when trash bags are used as liners, they are not securely fastened to the trash receptacle subjecting the trash bag to close occasionally due to the gravitational force exerted on the bottom of the trash bag as items are deposited therein.

Plastic trash bag holders of the latter type are disclosed in U.S. Pat. Nos. 4,890,653 and 4,979,547 issued to Hoerner. Hoerner discloses an elongated sleeve for holding a plastic trash bag in an upright, free-standing and open position. In these references, both sleeves have four side panels and a tab portion all of which are made of a rigid material such as cardboard which are coated with a water proof material. In both patents, the elongated sleeve is originally a pre-folded sheet in which the tab portion must be adhesively taped, stapled or riveted to a free edge of the panels in order to form a tubular structure. The sleeve is inserted into a plastic trash bag and the plastic trash bag is secured through two slits formed at the ends of the creases between two adjacent side panels.

U.S. Pat. No. 4,037,778 issued to Boyle also discloses a device having five or more rectangular side panels hingedly interconnected in which the central panel and its adjacent panels have finger holes enabling the user to readily insert his finger or thumb through these holes to help when inserting the device into a plastic bag.

U.S. Pat. No. 672,657 issued to Vautrot, discloses a collapsible funnel removably fitted into the mouth of the bag and held intact thereto with drawstrings. The funnel is used primarily in connection with a tobacco bag having strong, self-supporting walls, unlike a plastic trash bag.

These prior art devices do not incorporate an original prefabricated tubular base having pre-folded panels, an attached funneling unit which increases the area of the inlet of the tubular base so items can be deposited more easily within the tubular base, or means for securing the tubular base and the funneling unit. Moreover, the prior art devices fail to provide a reliable means for supporting a trash bag because both Boyle and Hoerner teach a sleeve originally manufactured and packaged in a sheet configuration which could collapse when the trash bag is being filled.

It would be a great advantage to provide an inexpensive, compact and reliable device for supporting a plastic trash bag in an open and upright position so that an individual can fill the plastic trash bag without having to repeatedly re-open it or receive assistance from another person.

SUMMARY OF THE INVENTION

A device is disclosed which enables a user of plastic trash bags to attain the maximum advantages and benefits afforded by such plastic bags and overcomes some of the above-mentioned disadvantages and limitations associated with conventional devices used to support plastic trash bags.

It is the object of the present invention to provide a plastic trash bag holder which secures a trash bag in an open and upright position without eliminating any advantages bestowed on consumers due to its lightweight, flexible construction and easy and compact storage.

It is also object of the present invention to provide an inexpensive means of supporting a plastic trash bag in an open and upright position.

It is a further object of the present invention to provide communities with an inexpensive way to promote recycling.

It is still further the object of the present invention to provide a plastic trash bag holder which can be easily cleaned.

It is another object of the present invention to provide a compact and easily stored device for holding a garbage bag open and erect during use.

These and other objects of the present invention are provided in a device for supporting a plastic trash bag in an open and upright position while protecting the plastic bag from becoming ripped and punctured, the device comprising a generally tubular base having a plurality of side panels coupled together to form the tubular base in which at least one of the side panels has a slit cut therethrough.

The funneling unit has a bore with an entrance and an exit, in which the exit has a cross sectional area less than the cross sectional area of the tubular base's inlet and the entrance has a cross sectional area greater than the cross sectional area of the tubular base's inlet. The funneling unit is mounted onto the tubular base with the entrance facing upward and attached thereto by a fastening means. Additionally, a securing means is preferably coupled to the funneling unit for securing the plastic trash bag to remain in an open and upright position.

After the funneling unit is attached and fastened to the tubular base by the fastening means, the tubular base is placed within the plastic trash bag, the trash bag is raised to an open and upright position, and the top borders of the plastic trash bag are secured by the securing means to fit snugly around the tubular base. Items are deposited within the tubular base. After the tubular base is filled, the plastic trash bag is detached from the securing means and the tubular base is removed from the trash bag causing the trash bag to become filled and remain in an upright position.

BRIEF DESCRIPTION OF THE DRAWINGS

The objects of the present invention will be described with respect to the following figures in which:

FIG. 1 is an illustration of the present invention in operation with a garbage bag disposed thereover.

FIG. 2 is a front view of the preferred embodiment of the funneling unit and a portion of the base member.

FIG. 3 is an illustration of the preferred embodiment of the present invention showing the method of assembling the funneling unit onto the base member.

DETAILED DESCRIPTION OF THE INVENTION

A device is described which is useful in supporting a plastic trash bag in an open and upright position while protecting the plastic trash bag from becoming ripped and punctured when sharp objects are deposited therein. The preferred embodiment of the present invention might best be described as a device made of corrugated paper with a waxed interior and exterior surface which supports plastic trash bags in an open and upright position to receive grass cuttings, foliage, recyclable products and other similar matter. Such a device provides its consumers with an inexpensive means of supporting plastic trash bags while it eliminates the disadvantages associated with using the trash bags. It should be borne in mind that the present invention need not be limited in use for supporting plastic trash bags, but may find wide application for supporting any product made of flexible material.

Referring now to FIG. 1, an embodiment of the present invention is illustrated while in operation. The present invention involves a device for supporting and filling a plastic trash bag comprising a tubular base 1 and a funneling unit 10, both of which are made of a substantially and continuously rigid material which is lightweight and of sufficient thickness to prevent tearing. The tubular base 1 and funneling unit 10 both having an interior surface and an exterior surface made of corrugated paper coated with a water-resistant substance such as wax or plastic, a water resistant material such as plastic, or even untreated corrugated paper. Both the tubular base 1 and the funneling unit 10 can be folded into a flat structure for easy storage and mobility.

Figure 8:
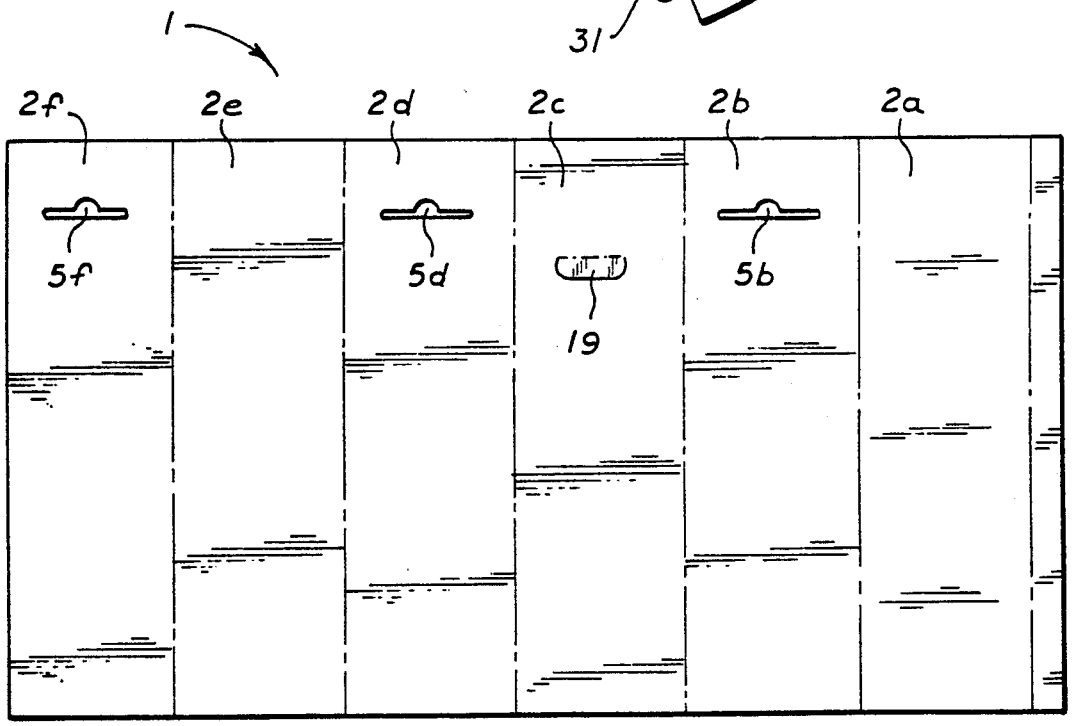
FIG. 8 is a plan view of the base member in an unfolded configuration.

As shown in FIGS. 1 and 8 the tubular base 1 comprises a plurality of side panels 2*a*, 2*b*, 2*c*, 2*d*, 2*e* and 2*f*. The side panels 2*a*, 2*b*, 2*c*, 2*d*, 2*e* and 2*f* are coupled together longitudinally to form the tubular base 1 having an inlet 3 and an outlet 4. When the tubular base is made of corrugated paper, the panels are formed preferably by scoring or a similar method. Three slits 5*b*, 5*d* and 5*f* all of which are shown in FIG. 8 but only slits 5*d* and 5*f* are shown in FIG. 1 are alternatively cut into three corresponding side panels 2*b*, 2*d* and 2*f*. These three slits are positioned substantially equidistant from the inlet 3 to provide equal support of the funneling unit 10. The slits have a fixed length and width.

Although the preferred embodiment of the tubular base comprises six side panels having three cut slits, there exists many other alternative embodiments of which the tubular base comprises at least three side panels coupled together leaving a sufficiently wide tubular base so disposed items can pass therethrough, and at least one slit cut into one of the side panels. Of course, those skilled in the art will realize that the number of slits and their respective orientation depends upon a number of factors including the number of side panels forming said tubular base and the desired strength of a connection between the funneling unit 10 to the tubular base 1.

Figure 7:
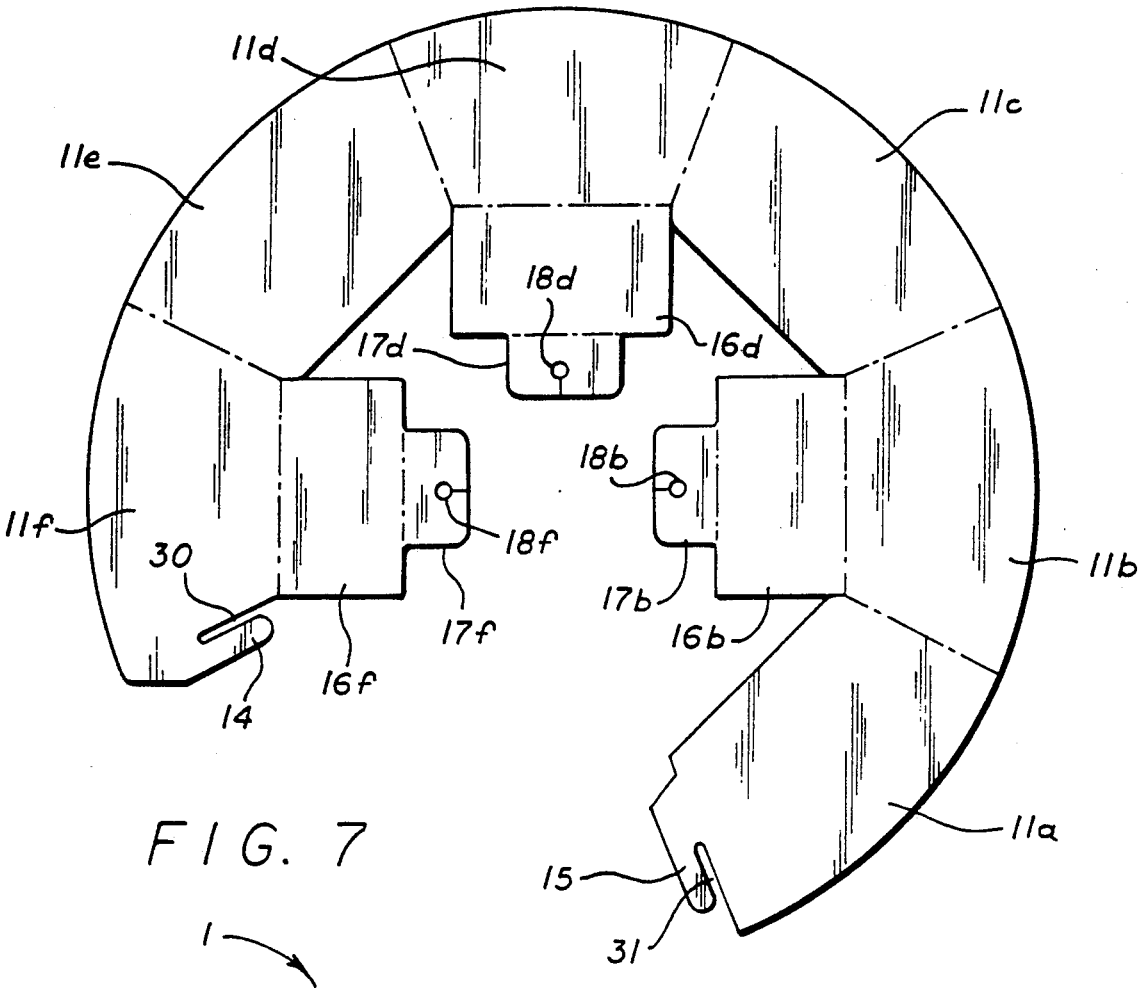
FIG. 7 is a plan view of the funnel member in an unfolded configuration.

The funneling unit 10, as shown in FIGS. 2 and 7, is detachably mounted on the tubular base 1. Preferably, the funneling unit 10 is mechanically affixed to the tubular base but may be affixed by a weak adhesive. The funneling unit 10 will be described in greater detail in subsequent paragraphs referencing FIGS. 2 and 7. Of course, although not illustrated in the drawings, in many circumstances, it may be desirable to have a funneling unit permanently affixed to the tubular base.

The tubular base 1 is inserted into the plastic trash bag 20 having an open top border 21, a closed end 22 and sidewalls 23. The tubular base 1 is positioned with the inlet 3 facing upward and the outlet 4 facing the closed end of the plastic trash bag 22. The plastic trash bag 20 is raised to an upright and open position. The open top borders of the plastic trash bag 21 are gathered and secured by a securing means which includes a plurality of cut apertures 18*b*, 18*d*, 18*f* formed in corresponding fastening flaps 17*b*, 17*d*, 17*f* further illustrated in FIGS. 4 and 5. The top borders of the plastic trash bag 21 are then pulled upward to tighten the plastic trash bag 20 around the tubular base 1.

An individual can then deposit items such as grass cuttings, foliage, recyclable products or other items within the tubular base 1. The deposited items initially enter the tubular base inlet 3 and fall therethrough to finally rest on the closed end of the plastic trash bag 22. Once the tubular base is filled, the individual dislodges the top borders 21 of the plastic trash bag from the cut apertures 18*b*, 18*d*, 18*f* and the tubular base 1 is lifted out of the plastic trash bag 20 causing it to fill and remain in an open and upright position.

The preferred embodiments of both the tubular device 1 and the funneling unit 10 are shown in FIG. 2. Similarly drawn in FIGS. 1 and 8, the tubular base 1 comprises six side panels 2*a*, 2*b*, 2*c*, 2*d*, 2*e* and 2*f* coupled together to form the tubular base and a plurality of slits 5*b*, 5*d* and 5*f* alternatively cut into said side panels 2*b*, 2*d* and 2*f*. In this preferred embodiment, the tubular base 1 also has a slot 19 cut into the side panel 2*c* which can be used as an handle for removing the device from the plastic trash bag 20 or for transporting the device while it is being utilized. However, such a slot is neither necessary for the tubular base 1 to function properly nor limited to one slot.

The funneling unit 10 comprises a semi-rigid bordering sheet 11 which is originally arched shaped and prefolded into sectional areas, labeled in FIGS. 2 and 7 as 11*a*, 11*b*, 11*c*, 11*d*, 11*e*, and 11*f*. When the funneling unit 10 is made of corrugated paper, these sectional areas are formed preferably by scoring or a similar method. These sectional areas can be any geometric shape but are preferably trapezoidal having a substantially parallel top edge 12*a*–12*f* with a greater length than a bottom edge 13*a*–13*f*. However, the bordering sheet 11 which when unlocked forms a flat sheet which can be easily cleaned and vacuumed packed.

The funneling unit 10 further comprises a means for interlocking the bordering sheet 11 into a funnel-shaped structure, a means for fastening the funneling unit 10 to the tubular base 1 and a means for securing the plastic trash bag 20 in an open and upright position. The interlocking means include a downward facing locking members 14 positioned adjacent to a first end sectional area 11*f* of the bordering sheet so that a first cavity 30 is formed between the downward facing locking member 14 and the first end sectional area 11*f*. Additionally, an upward facing locking member 15 positioned adjacent to a second end sectional area 11*a* of the bordering sheet so that a second cavity 31 is formed between the upward facing locking members 15 and the second end sectional area 11*a*. The locking members are engaged by inserting the first cavity 30 into the second cavity 31 causing the sectional areas of the bordering sheet 11 to become inwardly angled, in other words funnel-shaped, so that a circumference formed by the top edges 12*a*–12*f* of the sectional areas of the interlocked bordering sheet 11 is greater than a circumference formed by the lower edges 13*a*–13*f*. Of course, the interlocking means can be of any design such as a clamp, rivet, glue or the like so long as the means is capable of firmly holding the first end sectional area 11*f* to the second end sectional area 11*a*.

The fastening means is used to securely fasten the funneling unit 10 to the tubular base 1 and comprises a plurality of fastening panels 16*b*, 16*d*, 16*f* coupled with a corresponding fastening flaps 17*b*, 17*d*, 17*f* and the bordering sheet 11. The fastening panels 16*b*, 16*d*, 16*f* have widths approximately equal to the width of the side panels having the cut slits 2*b*, 2*d*, 2*f*. The fastening flaps 17*b*, 17*d*, 17*f* are preferably rectangular in design but can be of any shape corresponding to the cut slits 5*b*, 5*d*, 5*f* in which each fastening flap 17*b*, 17*d*, 17*f* has a length slightly less than the length of a corresponding slit 5*b*, 5*d*, 5*f* and a width slightly less than the width of the corresponding slit 5*b*, 5*d*, 5*f* in order to sufficiently hold each of the fastening flaps 17*b*, 17*d*, 17*f* in place after insertion through the corresponding slits 5*b*, 5*d*, 5*f*. The fastening means are aligned so that when the bordering sheet 11 is placed on the inlet 3 of the tubular base, the exterior surface of the fastening panels will be adjacent to the interior surface of the side panels having the slits 2*b*, 2*d*, 2*f* as shown in more detail in FIG. 6.

Figure 4:
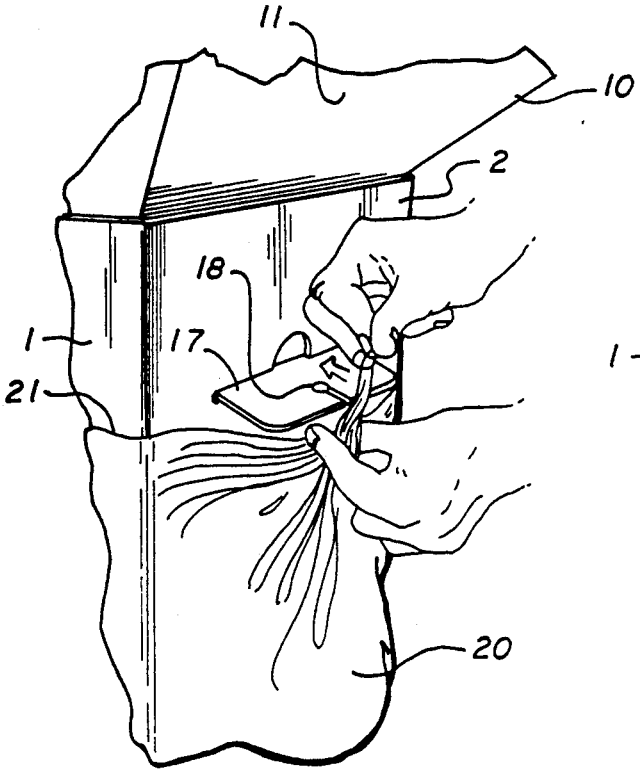
FIG. 4 is an illustration of a plastic trash bag being inserted through the cut aperture in the fastening insert which extends outwardly through the cut slit in the tubular base.
Figure 5:
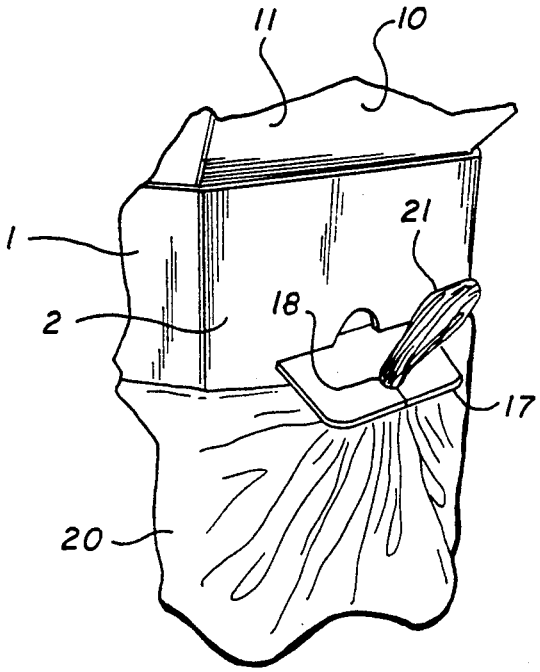
FIG. 5 shows the cut aperture securing the plastic trash bag.

The securing means in the preferred embodiment comprises the fastening flaps 17*b*, 17*d*, 17*f* having corresponding cut apertures 18*b*, 18*d*, 18*f* in which these cut apertures are positioned on the fastening flaps 17*b*, 17*d*, 17*f* so that once the fastening flap 17*b*, 17*d*, 17*f* is inserted outwardly through its corresponding cut slit 5*b*, 5*d*, 5*f*, the cut apertures protrudes from the exterior surface of said tubular base enabling the top borders of the plastic trash bag 21 to be secured thereto as shown in more detail in FIGS. 4 and 5. The securing means, of course, may include other constructions for the fastening flaps. For example, the fastening flaps may contain a clamping device having a jaw which attaches to the top border of the plastic trash bag to secure the plastic trash bag in an open and upright position (not shown).

Moreover, another embodiment of the funneling unit, not shown in the drawings, may consist of a funneling unit originally manufactured in a conventional funnel-shaped configuration having a bore therethrough, the bore having an entrance and an exit in which the exit has a cross sectional area less than the cross sectional area of the inlet of the tubular base. Additionally, the entrance has a cross sectional area greater than the cross sectional area of the inlet of the tubular base.

FIG. 3 illustrates the preferred embodiment of the funneling unit 10 fastened to the tubular base 1 before the device is inserted into the plastic trash bag. The funneling unit 10 is mounted upon the tubular base 1 and fastened by a fastening means. In this embodiment, the fastening means includes fastening panels (not shown) coupled with the corresponding sectional areas of the bordering sheet 11*b*, 11*d*, 11*f* and the corresponding fastening flaps 17*b*, 17*d*, 17*f* such that the interlocked bordering sheet 11 rests upon the tubular base inlet 3.

Figure 6:
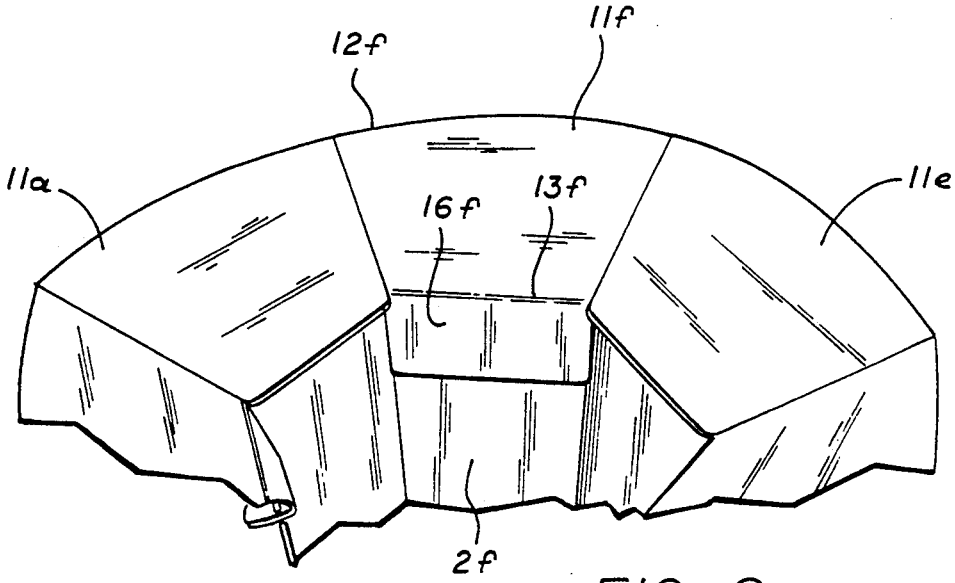
FIG. 6 is an upper perspective view of a portion of the preferred embodiment of the funneling unit when attached to the tubular base.

After the bordering sheet 11 is placed onto the tubular base 1, the fastening panels 16*b*, 16*d*, 16*f* are aligned with the corresponding side panels 2*b*, 2*d*, 2*f* with the cut slit. The fastening flaps 17*b*, 17*d*, 17*f* are inserted outwardly through the corresponding slits 5*b*, 5*d*, 5*f* so that the cut apertures 18*b*, 18*d*, 18*f* protrude from the tubular base surface 1. As a result, the fastening panel lays flush against the interior surface of the tubular base as shown in FIG. 6 which illustrates the fastening panel 16*f* in relation to the corresponding side panel 2*f* of the tubular base 1 and the bordering sheet 11 when the fastening panel 17*f* (not shown) is inserted through the corresponding slit 5*f*. Of course, since the funneling unit 10 and the tubular base 1 are geometrically compatible, i.e. the tubular base has six side panels and the funneling unit has a bordering sheet with six sectional areas of equivalent widths at the point of connection, it is possible to connect the funneling unit 10 to the tubular base 1 by inserting fastening flaps 17*b*, 17*d*, 17*f* outwardly through slits 5*d*, 5*f*, 5*b* or slits 5*f*, 5*b*, 5*d*.

The device described herein may be manufactured by many different methods and from many different materials. For example, the device can be manufactured as a single unit or as a plurality of units coupled together. Moreover, it can be made of corrugated paper, plastic or any lightweight material. While the present invention has been described in terms of various embodiments, other embodiments may come to mind to those skilled in the art without departing from the spirit and scope of the present invention. Also, although the present invention is described in terms of its preferred embodiment, many of its most important features have general application and are not intended to be limited for use only with plastic trash bags. The invention should, therefore, be measured in terms of the claims which follow.

What we claim is:

1. A device for supporting a plastic trash bag in an open and upright position while protecting said plastic bag from becoming ripped and punctured, said device comprising:

a generally tubular base having an exterior surface, said base comprising a plurality of side panels couplable together to form said tubular base and at least one of said side panels having a slit cut therethrough near one end thereof;

a foldable funneling unit having a bore therethrough, said bore having an entrance and an exit, said exit having a cross sectional area less than the cross sectional area of said tubular base and said entrance having a cross sectional area greater than the cross sectional area of said tubular base, said funneling unit being mountable on said tubular base with the entrance facing upward;

means for fastening said funneling unit to said tubular base; and means for securing said plastic trash bag to remain in an open and upright position on said device.

2. A device according to claim 1 wherein said tubular base is formed from a flat unitary sheet having a plurality of vertical pre-folded portions, and said funneling unit causing said tubular base to retain its tubular form during use.

3. A device according to claim 1 wherein said fastening means includes at least one fastening flap, said fastening flap is inserted outwardly through said slit so that said fastening flap protrudes from said exterior surface of said tubular base.

4. A device according to claim 1 wherein said securing means includes at least one fastening flap having a cut aperture in which said plastic bag having an open top border and a closed end is secured in an upright and open position by inserting said top border of said plastic bag through said cut aperture and pulling said top border therethrough.

5. A device for a plastic trash bag in an open and upright position while protecting said plastic bag from becoming ripped and punctured, said device comprising:

a tubular base having an inlet for receiving and passing disposable items therein, said tubular base having an interior and exterior surface and includes six side panels coupled together to form said tubular base with a hexagonal-shaped cross sectional area, at least one of said side panels having a slit cut therethrough;

a foldable funneling unit having a bore therethrough, said bore having an entrance and an exit, said exit having a hexagonal cross sectional area less than the hexagonal cross sectional area of said inlet of said tubular base and said entrance having a cross sectional area greater than the cross sectional area of said inlet of said tubular base, said exit of the funneling unit is mounted on said inlet of said tubular base; and means for fastening said funneling unit to said tubular base; and means for securing said plastic trash bag in an open and upright position, said securing means is coupled to said funneling unit.

6. A device according to claim 5 wherein said fastening means includes at least one fastening flap, said fastening flap having a length slightly less than the length of a corresponding slit and a width slightly less than the width of said corresponding slit in order to sufficiently hold said fastening flap in place after it is inserted outwardly through said corresponding slit so that said fastening flap protrudes from the exterior surface of said tubular base.

7. A device according to claim 5 wherein said securing means includes at least one fastening flap having a cut aperture in which said plastic bag having an open top border and a closed end is secured in an upright and open position by inserting said fastening flap outwardly through said slit so that said aperture protrudes from the exterior surface of said tubular base, said top border of said plastic bag is inserted through said cut aperture and pulled therethrough.

8. A device according to claim 5 wherein said tubular base includes a slot cut through at least one of said side panels adapted to operate as a handle.

9. A device for supporting a plastic trash bag in an open and upright position while protecting said plastic bag from becoming ripped and punctured, said device comprising:

a tubular base having an inlet and an outlet for receiving and passing disposable items therethrough, said tubular base having an interior and exterior surface and includes a plurality of side panels coupled together to form said tubular base, said side panels having slits alternatively cut into said side panels; and a detachable funneling unit including a bordering sheet pre-folded into a plurality of sectional areas, said bordering sheet is mounted on the inlet of said tubular base, means for interlocking said bordering sheet into a circular pattern causing said sectional areas become inwardly angled so that said bordering sheet becomes funnel-shaped, means for fastening said funneling unit to said tubular base and for securing said plastic bag in an open and upright position.

10. A device according to claim 9 wherein said tubular base includes a slot cut through at least one of said side panels, thereby to operate as a handle.

11. A device according to claim 9 wherein said fastening and securing means include a plurality of fastening panels having an interior and exterior surface, each of said fastening panels are alternatively coupled to said bordering sheet and coupled to a corresponding fastening flap in such a manner that said exterior surface of said fastening panel is adjacent to said interior surface of said tubular base when said corresponding fastening flap is inserted through said corresponding slit; and said plurality of fastening flaps coupled to said fastening panels, each of said fastening flaps having a cut aperture positioned so that when said fastening flaps are outwardly inserted through said corresponding slit, said cut aperture of each of said fastening flaps protrudes from the exterior surface of said tubular base.

12. The device according to claim 9 wherein said device is comprised of corrugated paper having waxed interior and exterior surfaces.

13. A device for supporting a plastic trash bag in an open and upright position while protecting said plastic bag from becoming ripped and punctured, said device comprising:

a generally tubular base having an exterior surface, said base comprising a plurality of side panels couplable together to form said tubular base and at least one of said side panels having a slit cut therethrough near one end thereof;

a funneling unit having a bore therethrough, said bore having an entrance and an exit, said exit having a cross sectional area less than the cross sectional area of said tubular base and said entrance having a cross sectional area greater than the cross sectional area of said tubular base, said funneling unit being mountable on said tubular base with the entrance facing upward;

means for fastening said funneling unit to said tubular base; and means for securing said plastic trash bag to remain in an open and upright position on said device, said securing means includes at least one fastening flap having a cut aperture in which said plastic bag having an open top border and a closed end is secured in an upright and open position by inserting said top border of said plastic bag through said cut aperture and pulling said top border therethrough.

14. A device for supporting a plastic trash bag in an open and upright position while protecting said plastic bag from becoming ripped and punctured, said device comprising:

a generally tubular base having an exterior surface, said base comprising a plurality of side panels couplable together to form said tubular base and at least one of said side panels having a slit cut therethrough near one end thereof;

a funneling unit having a bore therethrough, said bore having an entrance and an exit, said exit having a cross sectional area less than the cross sectional area of said tubular base and said entrance having a cross sectional area greater than the cross sectional area of said tubular base, said funneling unit being mountable on said tubular base with the entrance facing upward;

means for fastening said funneling unit to said tubular base; and means for securing said plastic trash bag to remain in an open and upright position on said device, said securing means includes at least one fastening flap having a cut aperture in which said plastic bag having an open top border and a closed end is secured in an upright and open position by inserting said fastening flap outwardly through said slit so that said aperture protrudes from the exterior surface of said tubular base, said top border of said plastic bag is inserted through said cut aperture and pulling said top border therethrough.

* * * * *